US006478635B2

(12) United States Patent
Charles et al.

(10) Patent No.: US 6,478,635 B2
(45) Date of Patent: Nov. 12, 2002

(54) ELECTRICAL CONNECTION DEVICE

(75) Inventors: Patrick-Nicolas Charles, Montmelian; Bernard Chevalier, Saint Baldoph, both of (FR)

(73) Assignee: Proner Comatel, Chapareillan (FR)

( * ) Notice: Subject to any disclaimer, the term of this patent is extended or adjusted under 35 U.S.C. 154(b) by 0 days.

(21) Appl. No.: 09/906,812

(22) Filed: Jul. 18, 2001

(65) Prior Publication Data

US 2002/0031958 A1 Mar. 14, 2002

(30) Foreign Application Priority Data

Jul. 18, 2000 (FR) ..... 00 09380

(51) Int. Cl.[7] ..... H01R 11/22
(52) U.S. Cl. ..... 439/851; 439/855
(58) Field of Search ..... 439/851, 855, 439/854, 830, 736, 282, 283, 722, 850, 881

(56) References Cited

U.S. PATENT DOCUMENTS 4,252,399 A * 2/1981 Bauerle ..... 439/851
4,550,972 A * 11/1985 Romak ..... 439/851
4,871,331 A * 10/1989 Kondo et al. ..... 439/736
5,106,329 A * 4/1992 Maeshima et al. ..... 439/851
5,135,418 A * 8/1992 Hatagishi et al. ..... 439/857
5,628,656 A * 5/1997 Macioce et al. ..... 439/851
5,873,754 A 2/1999 Hotea ..... 439/843
5,897,404 A * 4/1999 Goodman et al. ..... 439/843
5,957,715 A 9/1999 Fukuda ..... 439/271

FOREIGN PATENT DOCUMENTS

FR 0954063 A2 * 11/1999 ..... H01R/13/627
FR 2 778 275 11/1999

* cited by examiner

*Primary Examiner*—P. Austin Bradley
*Assistant Examiner*—Ross Gushi
(74) *Attorney, Agent, or Firm*—Young & Thompson

(57) ABSTRACT

In this electrical connection device comprising a female contact (27) which comprises a base portion (28) having, in a first end region (28*a*), at least one pair of flexible contact blades (29, 30, 31) and, in a second end region (28*b*), at least one pair of wings (32, 33) adapted to be seated on an electrical current supply conductor, there is provided in the transition region (28*c*) between the first and second end regions, two wings (34) which are bent toward each other and which bear end to end against each other so as to form with the base portion a closed rigidifying ring (35) which opposes deformation of the first end region (28*a*) and the modification of the spacing of the contact blades (29, 30, 31) when the wings (32, 33) are seated on the electrical conductor.

15 Claims, 3 Drawing Sheets

ELECTRICAL CONNECTION DEVICE

BACKGROUND OF THE INVENTION

The present invention relates to an electrical connection device usable particularly in automotive vehicles to ensure the connection of onboard electrical apparatus, of fuse boxes and relay boxes, for example.

The invention relates more particularly to an electrical connection device of the type comprising a female connector and a male connector, in which:

a) the female connector comprises an insulating base, which has a recess adapted to receive and to guide the male connector, a male contact tongue disposed in said recess to ensure electrical connection with the male connector, b) the male connector comprises an insulating casing, in which is disposed a female contact adapted to coact with said male contact tongue to ensure said electrical connection, c) the female contact comprises a base portion substantially in the form of a channel, with sidewalls which carry, in a first end region of the base portion, at least one pair of flexible contact blades adapted to grip said male contact tongue and defining a contact region, and a second end region of said base portion, at least one pair of wings adapted to be crimped on an electrical current supply conductor, the base portion of the female contact comprising a transition region between said first and second end regions.

In known electrical connection devices of the type defined above (see for example French patent 2 778 275 of the applicant), the female contact usually comprises several pairs of flexible contact blades, the two contact blades of each pair having a spacing less than the thickness of the male contact tongue of the female conductor so as to guarantee, in service, a high pressure and, accordingly, a good electrical contact between the contact blades of the female contact of the male connector and the male contact tongue of the female connector. The pairs of contact blades usually have different lengths to reduce the force of inserting the male tongue into the female contact.

However, when the wings carried by the sidewalls of the base portion of the female contact are crimped on an electrical current supply conductor, this crimping operation gives rise to a deformation of the sidewalls of said base portion, which deformation brings said sidewalls toward each other. This deformation affects the sidewalls principally in the second end region and in the transition region of the base portion, but it can also affect the sidewalls in the first end region of the base portion, where are located the flexible contact blades. As a result, there is a decrease of the spacing of the blades of at least one pair of contact blades, which decrease, in service, can render more difficult the insertion of the male tongue into the female contact.

On the other hand, in the mass production of known electrical connection devices of the type defined above, the insulating housing and the female contact of the male connectors are produced separately. The insulating housing comprises a cage of generally rectangular parallelepipedal shape, which is closed on four sides by two longitudinal walls and two transverse walls surrounding the contact zone defined by the pairs of contact blades. On a fifth side, the cage can be closed by a cover which is connected to the cage by a flexible hinge made by molding with the cage and the cover. During molding, two arches are formed on the cover and two stop notches are formed on the cage such that the arches can hook respectively on the stop notches, by snapping in, when the cover is swung on the cage to close its fifth side. Under these circumstances, the insulating housings and the female contacts, which are produced separately, must be brought to a mounting station in which each female contact must be manipulated individually to be placed in the corresponding insulating housing whose cover is in open position, then the cover of each housing must then be manipulated so as to be placed in the closed position.

Moreover, it appeared desirable, at least for certain applications, to provide an electrical connection device having a larger sealing against gas and humidity, in particular between the contact zone and the second end region of the base portion of the female contact.

SUMMARY OF THE INVENTION

The present invention thus principally has for its object to provide an electrical connection device in which the contact blades of the female contact are less sensitive to the deformation of the sidewalls of the base portion of said female contact, which is produced during the operation of crimping the wings of said base portion on an electrical current supply conductor.

Secondarily, the present invention has for its object to simplify the production of the male connector of the electrical connection device, whilst improving the sealing, in particular between the contact zone and the second end region of the base portion of the female contact.

To this end, the present invention has for its object an electrical connection device of the type defined above, characterized in that d) in the transition region, the sidewalls of the base portion in the form of a channel of the female contact, carry two wings which are bent toward each other and which bear end to end against each other so as to form with said base portion a closed rigidifying ring.

Under these circumstances, during the operation of crimping the wings of the base portion on an electrical current supply conductor, the rigidifying ring opposes what the deformation of the sidewalls propagates from the second end region of the base portion beyond the transition region up to the first end region of the base portion where the flexible contact blades are located.

The electrical connection device according to the invention can moreover have one or several of the following characteristics:

e) said closed rigidifying ring has a circular shape;

f) in the male connector, the insulating casing is overmolded on the female contact; in this case, the production of the male connector of the electrical connection device can be considerably simplified as will be described in detail later;

g) the insulating casing comprises a cage of generally rectangular parallelepipedal shape, which is closed on four sides by two longitudinal walls and two transverse walls surrounding the contact zone defined by said at least one pair of contact blades, and on a fifth side by a wall which is of one piece with the longitudinal and transverse walls of the cage and in which the first end region of the transition region of the base portion of the female contact, including the rigidifying ring, are embedded so as to create a sealed separation between said contact zone and the second end region of said base portion of the female contact; in this case, there is obtained a cage which is hermetically closed on five sides (there is no more cover which is connected more or less well to the cage) and a sealed separation is created between the contact zone and the second end region of the base portion of the female contact;

h) around the cage is disposed a joint adapted to ensure sealing between the casing of the male connector and the base of the female connector after inserting said cage into the recess of the base of the female connector; this characteristic also contributes to improving the sealing of the electrical connection device;

i) during overmolding of the insulating casing on the female contact, there is formed a locking means adapted to ensure locking of the male connector on the female connector.

As an intermediate product, the invention also has for its object a male connector having the characteristics indicated in paragraphs b), c) and d) above.

The male connector can moreover have one or several of the characteristics indicated in paragraphs e) to i) above.

Also as an intermediate product, the invention also has for its object a female contact having the characteristics indicated in paragraphs c) and d) above.

The female contact can moreover have the characteristic indicated in paragraph e) above.

BRIEF DESCRIPTION OF THE DRAWINGS

Other characteristics and advantages of the invention will become apparent from the following description of one embodiment of the electrical connection device, given by way of example with reference to the accompanying drawings, in which.

DESCRIPTION OF THE PREFERRED EMBODIMENTS

Figure 1:
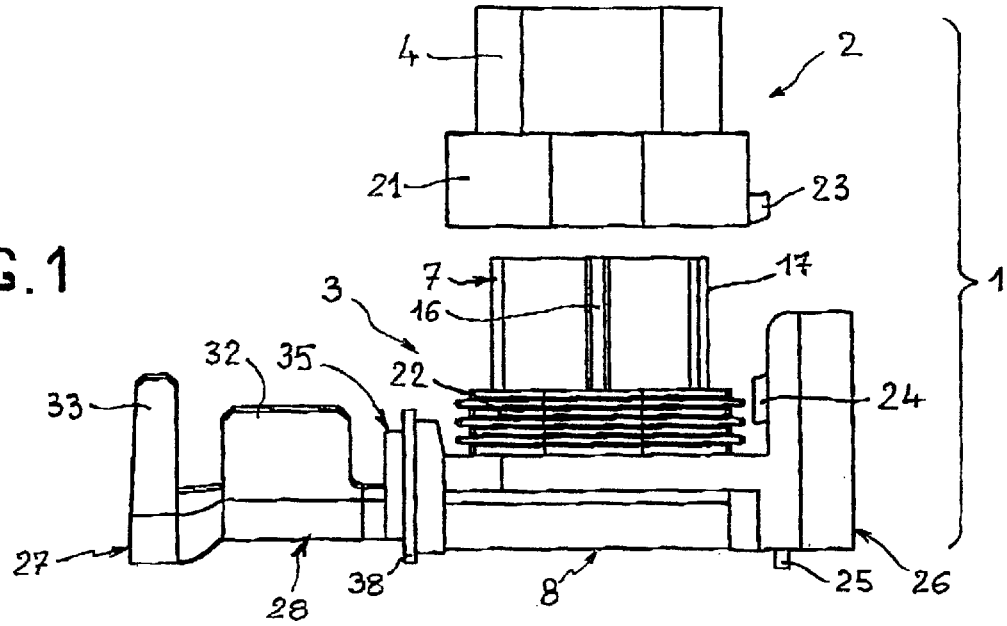
FIG. 1 is a side elevational view of a connection device according to the invention, the male and female connectors of the connection device being shown in the separated condition.
Figure 2:
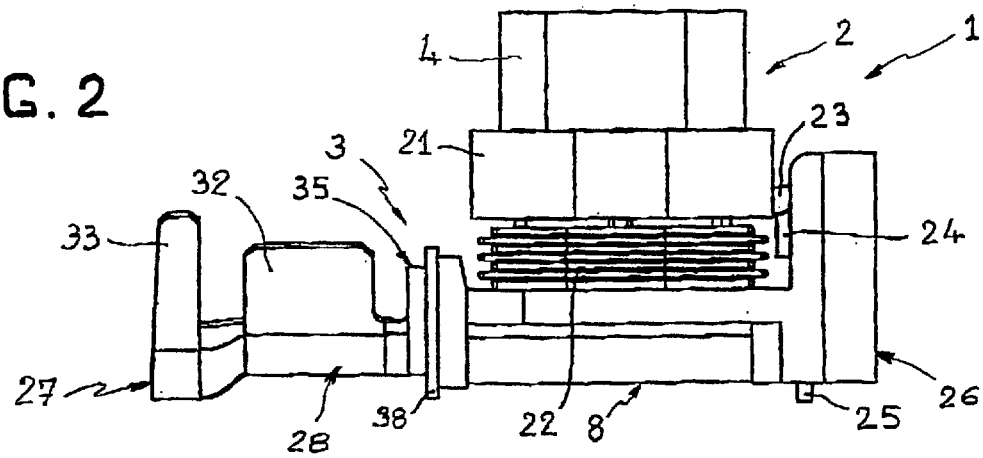
FIG. 2 is a view similar to FIG. 1, the male and female connectors being shown in the condition partially engaged with each other, but not yet locked.
Figure 3:
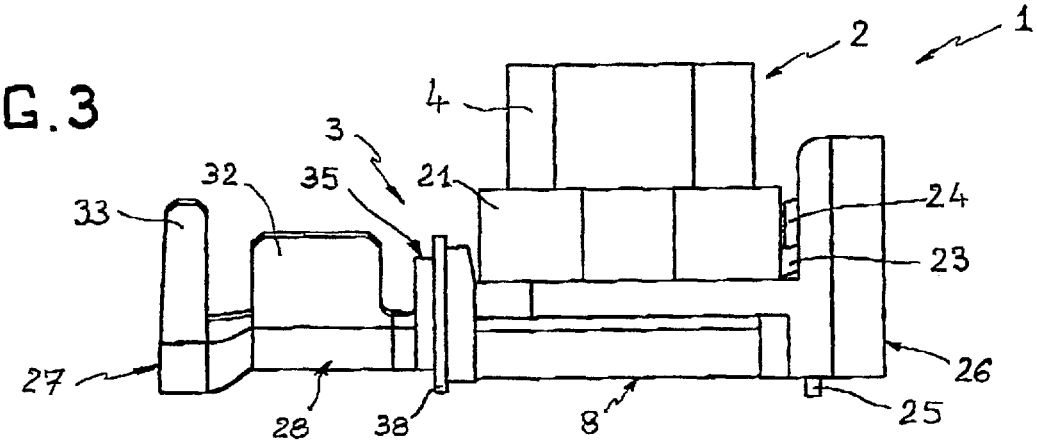
FIG. 3 is a view similar to FIGS. 1 and 2, the male and female connectors being shown in the condition completely engaged with each other and locked.
Figure 4:
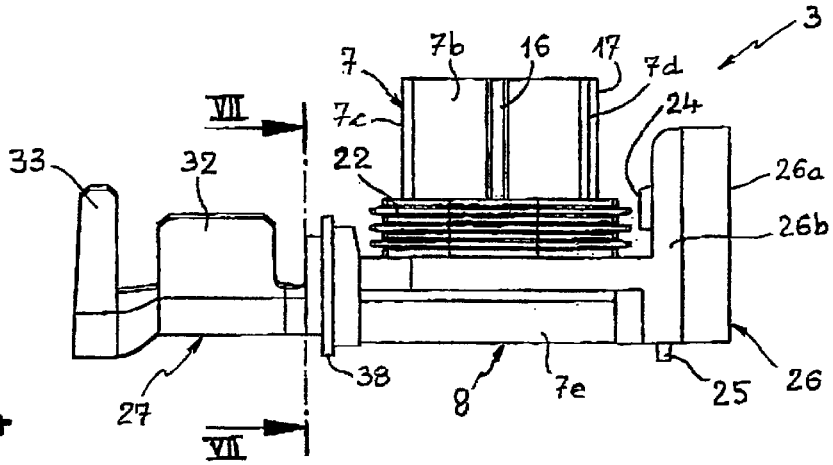
FIG. 4 is a side elevational view of the male connector alone.

The connection device 1 of FIGS. 1 to 3 is comprised essentially of a female connector 2 and a male connector 3.

A female connector 2 comprises a base 4 (FIGS. 1 to 3 and 10), and an insulating material which can be for example secured to an electrical apparatus to be connected (not shown). The base 4 has overall the general shape of a rectangular parallelepiped, whose edges oriented parallel to the insertion direction of the male connector into the female connector are rounded.

The base 4 comprises, on its surface 5 (FIG. 10), which in service is oriented toward the male connector 3, a recess or cavity 6 of generally rectangular shape, which is adapted to receive a portion 7 (FIG. 1) of a corresponding shape of the insulating housing 8 of the male connector 3. A male electrical contact tongue 9 projects from the bottom 11 of the recess 6 and extends over the major portion of the length of the recess 6, in the plane of symmetry of the base 4.

The sidewalls of the base 4 delimiting the recess 6 comprise, on the inner side, grooves 12, 13, 14 and 15 adapted to coact respectively with ribs 16, 17, 18 and 19 (FIGS. 5 and 8) which are carried by the portion 7 of the casing 8 of the male connector 3, to ensure guidance of this latter when its portion 7 is inserted into the recess 6 of the base 4 of the female connector 2. The grooves 12, 13, 14 and 15, on the one hand, and the ribs 16, 17, 18 and 19, on the other hand, are disposed symmetrically respectively in the recess 6 and on the portion 7 such that this latter can be inserted with only a single possible orientation into the recess 6 of the base 4.

On the side of the male connector 3, the base 4 of the female connector 2 is prolonged by a portion 21 in the form of a skirt (FIGS. 1 to 3 and 10), which is adapted to receive and to tightly surround a joint 22 (FIGS. 1, 2 and 4 to 8) which is carried by the portion 7 of the insulating casing 8 of the male connector 3 and which is located at the base of the ribs 16 to 19. The joint 22 can for example be constituted by a joint with three lips, of silicone, which is overmolded on the portion 7 of the insulating casing 8.

Substantially in the middle of one of its sides, the portion 21 in the form of a skirt of the base 4 comprises a projection 23 (FIGS. 1 to 3 and 10) adapted to coact with a stop notch 24 (FIGS. 1 to 6 and 8) of a locking lever 25 which is formed of a single piece, by molding, with the casing 8 of the male connector 3, to ensure locking between this latter and the female connector 2 when the portion 7 of the casing 8 is completely engaged in the recess 6 of the base 4, as shown in FIG. 3.

Figure 5:
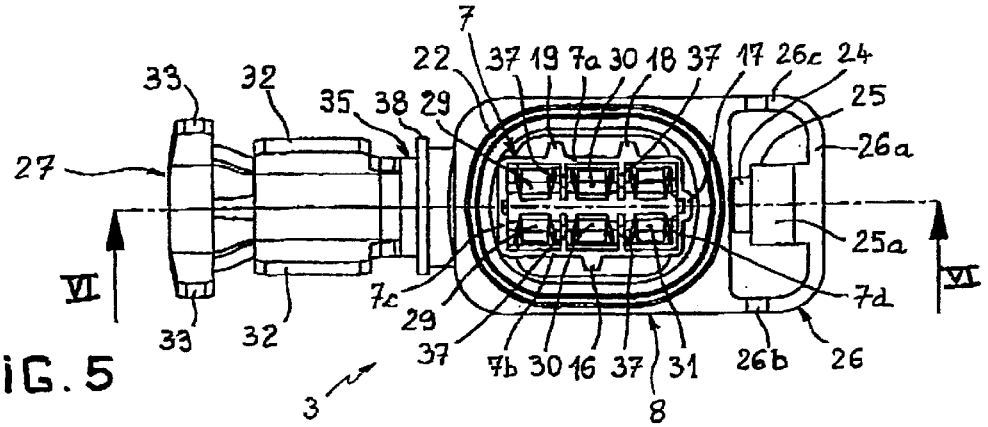
FIG. 5 is a top plan view of the male connector.
Figure 6:
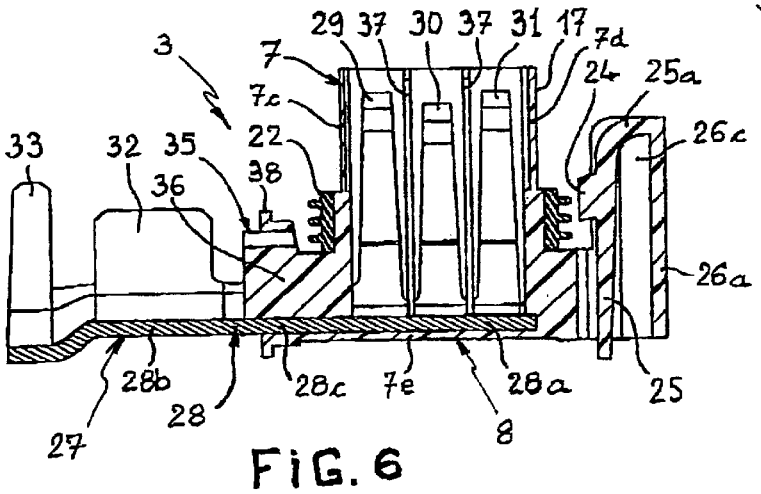
FIG. 6 is a cross-sectional view on the line VI—VI of FIG. 5.
Figure 8:
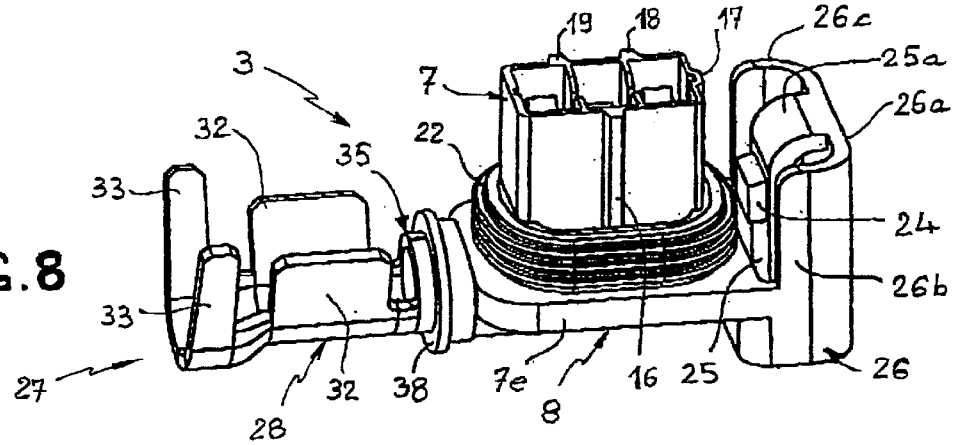
FIG. 8 is a side perspective view of the male connector.
Figure 9:
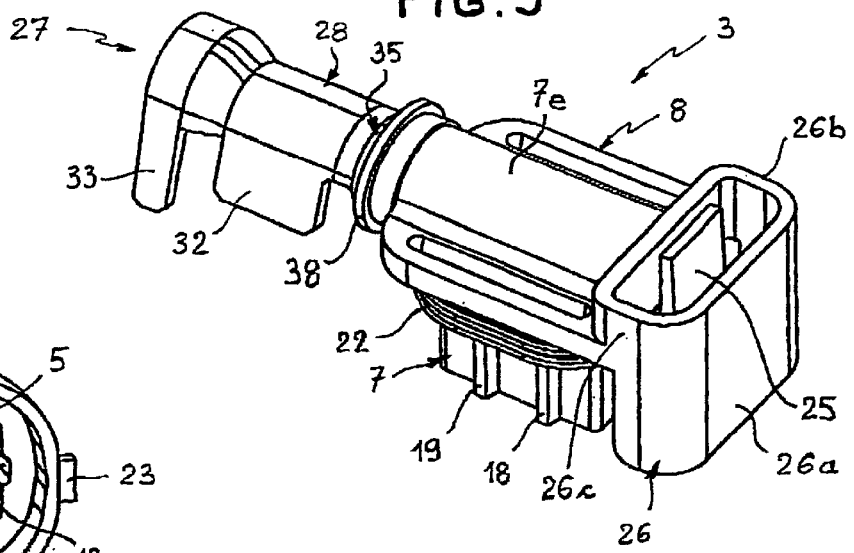
FIG. 9 is a perspective view from below of the male connector.
Figure 10:
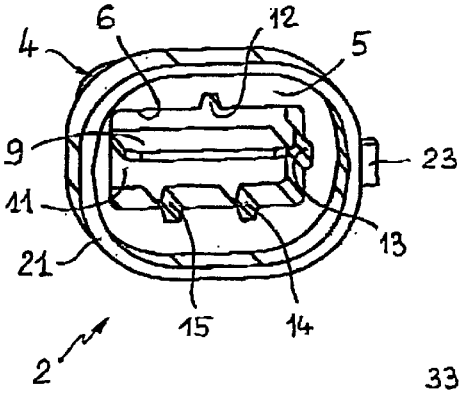
FIG. 10 is a perspective view from below of the female connector.

The locking lever 25 is constituted by a flexible tongue which extends parallel to the transverse wall 7*d* of the portion 7 of the casing 8, the stop notch 24 being carried by the surface of the flexible tongue which is oriented toward the transverse wall 7*d* as shown in FIGS. 5 and 6. The flexible tongue forming the locking lever 25 is surrounded on three sides by a protective cage 26 which has a generally substantially parallelepipedal shape and which is formed of a single piece, by molding, with the casing 8 of the male connector 3, as is more particularly shown in FIGS. 5, 6, 8 and 9. The protective cage 26 comprises a wall 26*a*, which extends parallel to the transverse wall 7*d* of the portion 7 of casing 8, and two walls 26*b* and 26*c* which, in their lower portion, connect as a single piece to the casing 8. At its upper end, the flexible tongue forming the locking lever 25 connects as a single piece, by a curved portion 25*a*, with the wall 26*a* of the cage 26, in the medial region of the upper edge of this wall 26*a*, as shown in FIGS. 6 and 8. Preferably, the lower end of the flexible tongue forming the locking lever 25 projects slightly toward the exterior beyond the lower end of the cage 26, such that the locking lever can be actuated manually or with the help of a suitable tool, such as a screwdriver, when it is desired to detach the male connector 3 from the female connector 2.

Figure 11:
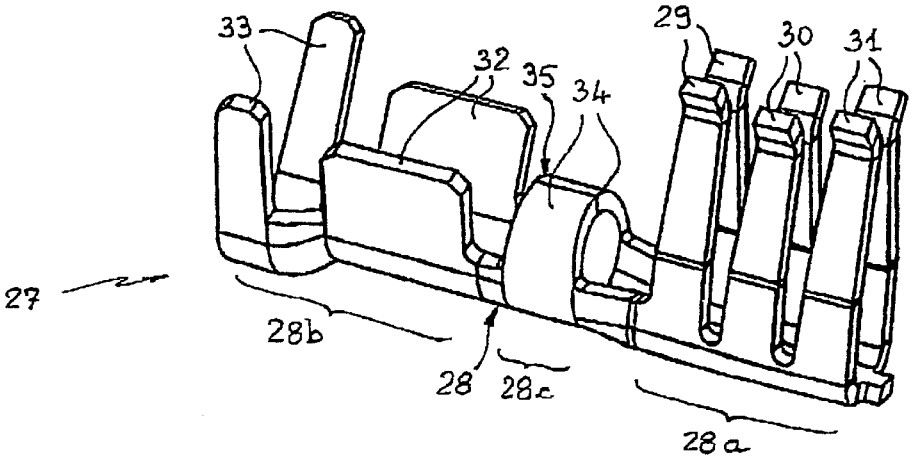
FIG. 11 is a perspective view of a female connector adapted to be incorporated in the male connector.

The male connector 3 comprises a female contact 27 which is at least partially disposed in the casing 8. The female contact 27 is shown in FIG. 11 in the condition separated from the male connector 3. The female contact 27 can be mass produced from a strip of conductive metal by known cutting out and bending techniques. As shown in FIG. 11, the female contact 27 comprises, in a known manner, a base portion 28 substantially in the form of a channel with a semicircular transverse cross-section, whose sidewalls carry, in a first end region 28*a* of the base portion, at least one pair of flexible contact blades, for example three pairs of flexible contact blades 29, 30 and 31, which, in service, are adapted to grip the male contact tongue 9 of the female connector 2 to establish an electrical connection with it.

Each pair of blades 29, 30 or 31 is in the form of a lyre and the pairs of blades are preferably of different length to reduce the insertion force of the male contact tongue 9 into the female contact 27.

As is also known, the sidewalls of the base portion 28 of the female contact 27 carry, in a second end region 28*b* of the base portion, at least one pair of wings, preferably two pairs of wings 32 and 33, adapted to be crimped on an electrical current supply conductor (not shown). Usually, the two wings 32 are crimped on a stripped end of the electrical conductor, whilst the two wings 33 are crimped on the sheath of said conductor.

As indicated above, the crimping of the wings 32 and 33 on the electrical conductor gives rise to a deformation of the sidewalls of the base portion 28, which can propagate to the end region 28*a* and give rise to a modification, in particular a decrease, of the spacing of the blades of each pair of blades 29, 30 and 31. To overcome this drawback, during cutting out from the strip of conductive material to form a flat blank from which the female contact 27 will then be formed by bending, two wings 34 are cut out from the strip of conductive material so as to be adjacent respectively to the two sides of the base portion 28 in the transition region 28*c* between the two end regions 28*a* and 28*b*.

Figure 7:
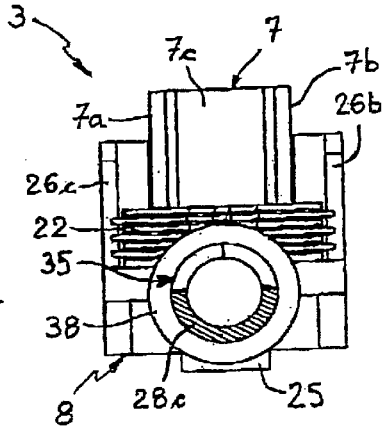
FIG. 7 is a cross-sectional view on the line VII—VII of FIG. 4.

During bending of the blank thus obtained, before crimping the pairs of wings 32 and 33 on the electrical conductor, the two wings 34 are bent toward each other, such that they bear end to end against each other as shown in FIG. 11. Thus, the two wings 34 form, in combination with the transition region 28*c* of the base portion, a closed rigidifying ring 35, which resists deformation of the sidewalls of the base portion 28 in the end region 28*a* of this latter when the wings 32 and 33 are ultimately crimped on the electrical conductor. Preferably, the rigidifying ring 35 has a circular shape as shown in FIGS. 7 and 11.

In a preferred embodiment of the invention, all the casing 8 of the male connector 3, with the locking lever 25 and its protective cage 26, is produced by overmolding on the female contact 27. The portion 7 of the casing 8 constitutes a cage of generally rectangular parallelepipedal shape, which is closed on four sides by two longitudinal walls 7*a*, 7*b* and two transverse walls 7*c* and 7*d*, surrounding the contact blades 29, 30 and 31, and on a fifth side by a bottom wall 7*e* which is of a single piece with the longitudinal and transverse walls of the cage. The bottom wall 7*e* projects outwardly beyond the four walls 7*a* to 7*d* of the cage 7 and forms a seat for the joint 22. On the side of the wall 7*d*, the bottom wall 7*e* is connected by one piece to the sidewalls 26*b* and 26*c* of the protective cage 26.

The end region 28*a* and the transition region 28*c* of the base portion of the female contact 27, including the rigidifying ring 35, are embedded in the bottom wall 7*e*. Thus, there is formed a sealed separation 36 (FIG. 6) between the contact zone, in which is located the contact blades 29, 30 and 31, and the crimping zone of the electrical conductor, which is formed by the end region 28*b* and the base portion 28 and by the wings 32 and 33 of the female contact 27. Under these circumstances, when the cage 7 of the casing 8 of the male connector 3 is completely received within the recess 6 of the base 4 of the female connector 2 and the skirt 21 of the base 4 tightly surrounds the joint 22, the contact zone is completely isolated from the exterior, such that there is obtained an electrical connection device that is well sealed.

As shown in FIGS. 5 and 6, during molding of the casing 8 of the male connector 3, guide ribs 37 can preferably be formed on the internal surface of the longitudinal walls 7*a*, 7*b* of the cage 7, to ensure the 15 guidance of the male contact tongue 9 of the female connector 2 between the contact blades 29, 30 and 31 until the male connector and the female connector are disposed within each other.

During molding of the casing 8 of the male connector 3, there can also be formed, in the region of the rigidifying ring 35, a flange or small collar 38 for hooking on a protective sheath for the electrical cable and the crimping zone of the female contact 27.

When the casing 8 of the male connector is obtained by overmolding on the female contact 27, the production of the male connector can be greatly simplified and its industrial cost reduced.

To this end, the molding station, which is necessary anyway for the production of the casing of the male connector, can be integrated into the mass production line of the female contacts 27, which permits eliminating the transfer operations which were until then necessary to bring the female contacts and the casings individually to an assembly point, as well as the assembly operations themselves.

Thus particularly the casing 8 of the male connector 3 could be overmolded onto the female contact 27 after the operation of crimping of a sheathed electrical conductor in the crimping zone formed by the end region 28*b* of the base portion 28 and by the wings 32 and 33 of the female contact, such that the crimping zone of the female contact and a portion of the sheath of the electrical conductor will thus be completely clad with the plastic material of the casing 8.

Moreover, although the invention has been particularly described with reference to a preferred embodiment of the invention, in which the casing 8 of the male conductor 3 is overmolded onto the female contact 27, the invention is applicable generally to a male connector in which the female contact 27, provided with a rigidifying ring 35, is disposed in a casing of the type of those which are described in French 2 778 275.

What is claimed is:

1. An electrical connection device comprising a female connector (2) and a male connector (3), in which a) the female connector (2) comprises an insulating base (4), which has a recess (6) adapted to receive and to guide the male connector, and a male contact tongue (9) disposed in said recess to ensure electrical connection with the male connector, b) the male connector (3) comprises an insulating casing (8), in which is disposed a female contact (27) adapted to coact with said male contact tongue (9) to ensure said electrical connection, c) the female contact (27) comprises a base portion (28) substantially in the form of a channel, with sidewalls which carry, in a first end region (28*a*) of the base portion, at least one pair of flexible contact blades (29, 30, 31) adapted to grip said male contact blade (9) and defining a contact zone, and in a second end region (28*b*) of said base portion, at least one pair of wings (32, 33) adapted to be crimped on an electrical supply conductor, the base portion (28) of the female contact comprising a transition region (28*c*) between said first and second end regions, and d) in the transition region (28*c*), the sidewalls of the base portion (28) in the form of a channel of the female contact carry two wings (34) which are bent toward each other and which bear end to end against each other so as to form with said base portion a closed rigidifying ring (35) that prevents a deformation of said second end region (28*b*), due to crimping said at least one pair of wings (32, 33) on an electrical conductor, from being propagated through said transition region (28*c*) to said first end region (28*a*).

2. The connection device according to claim 1, wherein the closed rigidifying ring (35) has a circular shape.

3. The connection device according to claim 1, wherein the insulating casing (8) is overmolded on the female contact (27).

4. The connection device according to claim 3, wherein the insulating casing (8) comprises a cage (7) of generally rectangular parallelepipedal shape, which is closed on four sides by two longitudinal walls (7*a*, 7*b*) and two transverse walls (7*c*, 7*d*) surrounding the contact zone defined by said at least one pair of the contact blades (29, 30, 31), and on a fifth side by a wall (7*e*) which is of a single piece with the longitudinal and transverse walls of the cage (7) and in which the first end region (28*a*) and the transition region (28*c*) of the base portion (28) of the female contact (27), including the rigidifying ring (35), are embedded so as to create a sealed separation (36) between said contact zone and the second end region (28*b*) of said base portion of the female contact.

5. The connection device according to claim 4, wherein around the cage (7) is disposed a joint (22) adapted to ensure sealing between the casing (8) of the male connector (3) and the base (4) of the female connector (2) after inserting said cage into the recess (6) of the base of the female connector.

6. The connection device according to claim 3, wherein during overmolding of the insulating casing (8) on the female contact (27), there is formed a locking means (24, 25) adapted to ensure a locking of the male connector (3) on the female connector (2).

7. A male connector comprising:

an insulating casing (8), in which is disposed a female contact (27) adapted to coact with a male contact tongue (9) of a female connector (2), said female contact (27) comprising a base portion (28) substantially in the form of a channel, with sidewalls which carry, in a first end region (28*a*) of th base portion, at least one pair of flexible contact blades (29, 30, 31) adapted to grip said male contact tongue (9) and defining a contact zone, and in a second end region (28*b*) of said base portion, at least one pair of wings (32, 33) adapted to be seated on an electric current supply conductor, the base portion (28) of the female contact comprising a transition region (28*c*) between said first and second end regions in which the sidewalls of the base portion (28) carry two wings (34) which are bent toward each other and bear end to end against each other so as to form with said base portion a closed rigidifying ring (35) that prevents a deformation of said second end region (28*b*), due to crimping said at least one pair of wings (32, 33) on an electrical conductor, from being propagated through said transition region (28*c*) to said first end region (28*a*).

8. The male connector according to claim 7, wherein said closed rigidifying ring (35) has a circular shape.

9. The male connector according to claim 7 or 8, wherein the insulating casing (8) is overmolded on the female contact (27).

10. The male connector according to claim 9, wherein the insulating casing (8) comprises a cage (7) of generally rectangular parallelepipedal shape, which is closed on four sides by two longitudinal walls (7*a*, 7*b*) and two transverse walls (7*c*, 7*d*) surrounding the contact zone defined by said at least one pair of contact blades (29, 30, 31), and on a fifth side by a wall (7*e*) which is of a single piece with the longitudinal and transverse walls of the cage and in which the first end region (28*a*) and the transition region (28*c*) of the base portion (28) of the female contact (27), including the rigidifying ring (35), are embedded so as to create a sealed separation (36) between said contact zone and the second end region (28*b*) of said base portion of the female contact.

11. A female contact adapted to coact with a male contact tongue (9) to ensure an electrical connection, said female contact (27) comprising:

a base portion (28) substantially in the form of a channel, with sidewalls which carry, in a first end region (28*a*) of the base portion, at least one pair of flexible contact blades (29, 30, 31) adapted to grip said male contact tongue and defining a contact zone, and in a second end region (28*b*) of said base portion, at least one pair of wings (32, 33) adapted to be seated on an electrical current supply conductor, the base portion (28) of the female contact comprising a transition region (28*c*) between said first and second end regions in which the sidewalls of the base portion (28) carry two wings (34) which are bent toward each other and bear end to end against each other so as to form with said base portion a closed rigidifying ring (35) that prevents a deformation of said second end region (28*b*), due to crimping said at least one pair of wings (32, 33) on an electrical conductor, from being propagated through said transition region (28*c*) to said first end region (28*a*).

12. The female contact according to claim 11, wherein said closed rigidifying ring (35) has a circular shape.

13. An electrical connection device comprising a female connector (2) and a male connector (3), in which a) the female connector (2) comprises an insulating base (4), which has a recess (6) adapted to receive and to guide the male connector, and a male contact tongue (9) disposed in said recess to ensure electrical connection with the male connector, b) the male connector (3) comprises an insulating casing (8), in which is disposed a female contact (27) adapted to coact with said male contact tongue (9) to ensure said electrical connection, c) the female contact (27) comprises a base portion (28) substantially in the form of a channel, with sidewalls which carry, in a first end region (28*a*) of the base portion, at least one pair of flexible contact blades (29, 30, 31) adapted to grip said male contact blade (9) and defining a contact zone, and in a second end region (28*b*) of said base portion, at least one pair of wings (32, 33) adapted to be crimped on an electrical supply conductor, the base portion (28) of the female contact comprising a transition region (28*c*) between said first and second end regions, and d) in the transition region (28*c*), the sidewalls of the base portion (28) in the form of a channel of the female contact carry two wings (34) which are bent toward each other and which bear end to end against each other so as to form with said base portion a closed rigidifying ring (35), wherein the insulating casing (8) is overmolded on the female contact (27), wherein the insulating casing (8) comprises a cage (7) of generally rectangular parallelepipedal shape, which is closed on four sides by two longitudinal walls (7*a*, 7*b*) and two transverse walls (7*c*, 7*d*) surrounding the contact zone defined by said at least one pair of the contact blades (29, 30, 31), and on a fifth side by a wall (7*e*) which is of a single piece with the longitudinal and transverse walls of the cage (7) and in which the first end region (28*a*) and the transition region (28*c*) of the base portion (28) of the female contact (27), including the rigidifying ring (35), are embedded so as to create a sealed separation (36) between said contact zone and the second end region (28*b*) of said base portion of the female contact.

14. The connection device according to claim 13, wherein around the cage (7) is disposed a joint (22) adapted to ensure sealing between the casing (8) of the male connector (3) and the base (4) of the female connector (2) after inserting said cage into the recess (6) of the base of the female connector.

15. A male connector comprising:

an insulating casing (8), in which is disposed a female contact (27) adapted to coact with a male contact tongue (9) of a female connector (2), said female contact (27) comprising a base portion (28) substantially in the form of a channel, with sidewalls which carry, in a first end region (28*a*) of th base portion, at least one pair of flexible contact blades (29, 30, 31) adapted to grip said male contact tongue (9) and defining a contact zone, and in a second end region (28*b*) of said base portion, at least one pair of wings (32, 33) adapted to be seated on an electric current supply conductor, the base portion (28) of the female contact comprising a transition region (28*c*) between said first and second end regions in which the sidewalls of the base portion (28) carry two wings (34) which are bent toward each other and bear end to end against each other so as to form with said base portion a closed rigidifying ring (35), wherein the insulating casing (8) is overmolded on the female contact (27), wherein the insulating casing (8) comprises a cage (7) of generally rectangular parallelepipedal shape, which is closed on four sides by two longitudinal walls (7*a*, 7*b*) and two transverse walls (7*c*, 7*d*) surrounding the contact zone defined by said at least one pair of contact blades (29, 30, 31), and on a fifth side by a wall (7*e*) which is of a single piece with the longitudinal and transverse walls of the cage and in which the first end region (28*a*) and the transition region (28*c*) of the base portion (28) of the female contact (27), including the rigidifying ring (35), are embedded so as to create a sealed separation (36) between said contact zone and the second end region (28*b*) of said base portion of the female contact.

* * * * *